United States Patent [19]

Kelly et al.

[11] 4,148,032

[45] Apr. 3, 1979

[54] METHOD AND MEANS FOR DEFOCUSING ENGINE CAVITY REFLECTED ENERGY

[75] Inventors: John D. Kelly; Wayne S. Hammond; Gordon A. Taylor, all of Seattle, Wash.

[73] Assignee: The United States of America as represented by the Secretary of the Navy, Washington, D.C.

[21] Appl. No.: 846,091

[22] Filed: Oct. 27, 1977

[51] Int. Cl.[2] ..... H01Q 15/14; H01Q 17/00

[52] U.S. Cl. ..... 343/18 A; 343/18 B

[58] Field of Search ..... 343/18 A, 18 B, 18 E, 343/705, 708; 333/98 M

[56] References Cited

U.S. PATENT DOCUMENTS

| | | | |
|---|---|---|---|
| 2,527,918 | 10/1950 | Collard | 343/18 R |
| 3,307,186 | 2/1967 | Straub | 343/18 A |
| 3,487,410 | 12/1969 | Barnett et al. | 343/18 A |
| 3,509,568 | 4/1970 | Manning et al. | 343/18 A |
| 3,838,425 | 9/1974 | Ishimitsu et al. | 343/18 A |

*Primary Examiner*—Maynard R. Wilbur
*Assistant Examiner*—Lawrence Goodwin
*Attorney, Agent, or Firm*—R. S. Sciascia; L. I. Shrago; C. E. Vautrain, Jr.

[57] ABSTRACT

Radar wave energy entering aircraft engine cavities is substantially dispersed by providing within such cavities surfaces having perturbations or dipoles which interact with the electromagnetic energy within the cavity interior, causing the reflected energy to be defocused or scattered over a broad range of angles thereby substantially lowering the radar cross section of the cavities.

6 Claims, 7 Drawing Figures

METHOD AND MEANS FOR DEFOCUSING ENGINE CAVITY REFLECTED ENERGY

This invention concerns control of aircraft radar reflections and, more particularly, effecting such control by decreasing the effective radar cross section of engine cavities.

The ability of military aircraft to penetrate modern enemy defensive systems is determined to a large degree by the air-craft radar cross section (RCS). Where the RCS is controlled to a suitably low level, enemy radar detection and tracking capabilities are severely degraded. Although aircraft have many multi-curved surfaces from which impinging radar energy is deflected, cavities on the aircraft such as engine inlets and exhaust nozzles reflect and rereflect impinging radar energy to such an extent that some of the emergent energy is directed back toward the radar transceiver. Unfortunately, these cavities act in this manner for practically all radar frequencies. It is, therefore, fundamental to the control of the aircraft RCS to control the RCS contribution from engine cavities.

Attempts to reduce the RCS of aircraft engine cavities have been directed primarily to lining the cavities with radar absorber materials and/or inserting lossy dielectric grids or reflecting screens over the cavity apertures. The latter are not fully effective and have the severe disadvantages of degrading propulsion performance and introducing deicing difficulties. The radar absorber linings are disadvantageous in being severely limited in temperature, strength and weight. Although each of these prior techniques perform satisfactorily for certain specific applications, none is generally applicable for all engine cavities. The present invention provides novel methods and means for controlling the effective engine cavity RCS which complement installed devices and afford greater control or improved strength, weight or temperature capabilities.

Accordingly, it is an object of the present invention to provide methods and means for control of engine aircraft cavity RCS which are compatible with aero/-propulsion performance requirements.

Another object of this invention is to provide a greater degree of RCS control of engine cavity reflections in a manner that complements existing devices while increasing the degree of RCS control.

A further object of this invention is to provide novel methods and means for control of aircraft radar reflections by decreasing the effective RCS of engine cavities through arrangements of surface perturbations which interact with the electromagnetic energy propagating within the interior of the engine cavity.

Other objects, advantages and novel features of the invention will become apparent from the following detailed description thereof when considered in conjunction with the accompanying drawings in which like numerals represent like parts throughout and wherein.

The present invention, in general, provides methods and means for substantially dispersing electromagnetic energy entering engine cavities by providing within such cavities surfaces having perturbations or dipoles which interact with the electromagnetic energy within the cavity interior in such a manner as to cause the reflected energy to be defocused or scattered over a broad range of angles thereby substantially lowering the radar cross section of the cavity. Such defocusing increases the electrical current density on the cavity walls, and this increased density can be used to attenuate the currents in a relatively small amount of lossy material.

Figure 1:
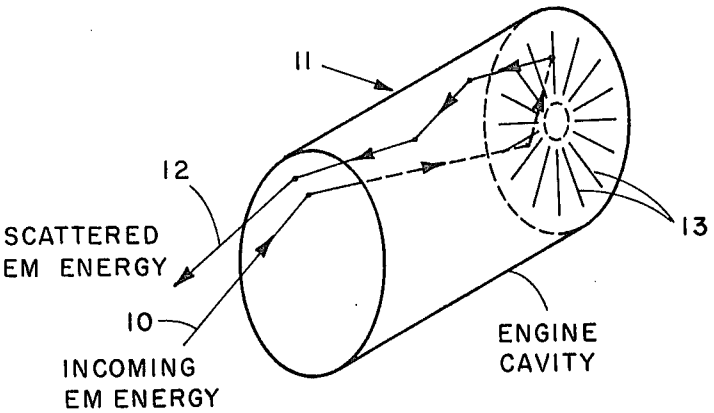
FIG. 1 is a schematic drawing of an aircraft engine cavity showing incoming and emergent electromagnetic energy.

Referring to the drawings, FIG. 1 illustrates the manner in which electromagnetic radar wave energy indicated at 10 enters an engine cavity 11, is reflected and rereflected within the cavity, and emerges from the cavity as indicated at 12. This radar energy normally proceeds down the cavity, striking the walls and turbine blades 13, and ultimately being reflected back out of the cavity in a direction substantially reverse to the direction of entry. The concentration of energy reflected from a bare cavity can be appreciated by visualizing a multiplicity of incoming beams 10 and emerging beams 12, with the emerging beams being substantially concentrated so as to form a generally focused beam which is readily received by receiving equipment at the radar station.

Figure 3:
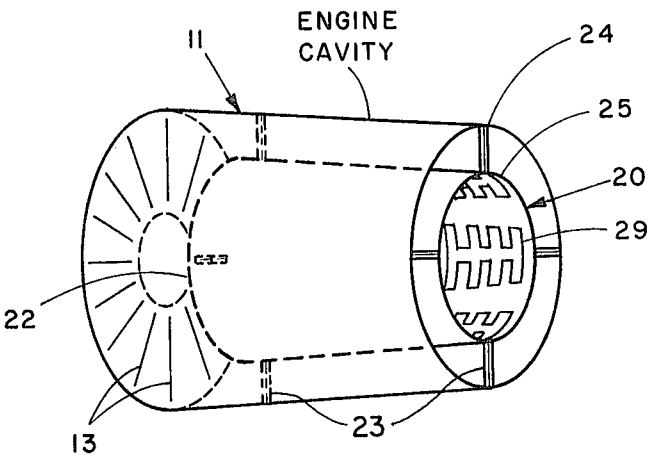
FIG. 3 is a schematic drawing of an engine cavity having a preferred embodiment of the energy dispersing means of the present invention disposed therein.
Figure 2:
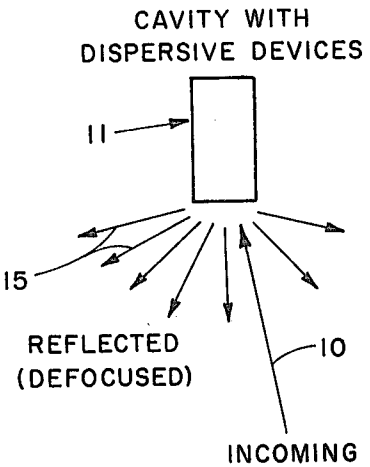
FIG. 2 is a schematic drawing illustrating the manner in which incoming electromagnetic energy can be defocused by dispersive devices in the engine cavity.

FIG. 2 shows the effect of installing dispersive devices within the cavity which cause the reflected energy to be scattered or defocused over a broad range of angles as indicated by diverging arrows 15, thereby substantially lowering the RCS of the cavity. The means for producing such defocusing may have several forms, a preferred one of which is shown in FIG. 3 wherein an RCS control means 20 is centrally disposed in the cavity, spaced from turbine blades 13 at end 22 by brackets 23 which preferably are electrically conductive, and positioned substantially coplanar with engine cavity entrance 24 as indicated at 25. In this embodiment, control means 20 is made of metal and has a plurality of suitably formed repetitive regular openings as indicated at 29 to selectively break up any similar forms or patterns of reflective paths of the emerging energy.

Figure 4:
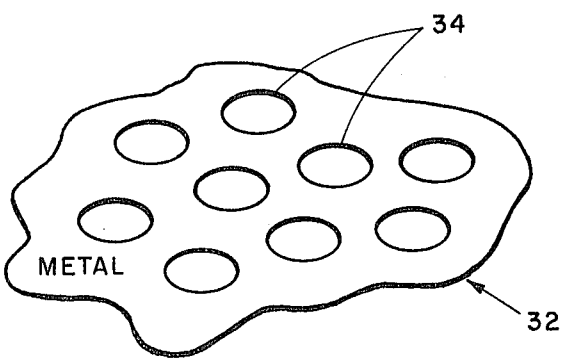
FIG. 4 is a schematic drawing of an alternate form of surface perturbations for dispersing energy.
Figure 6:
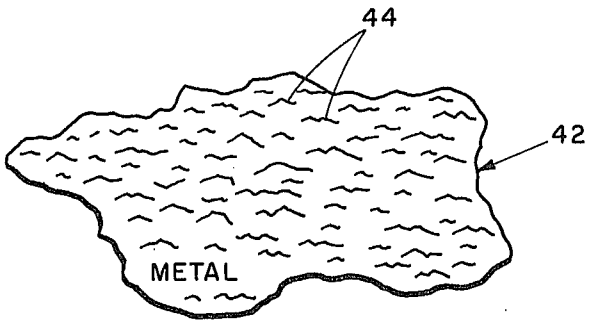
FIG. 6 is a schematic drawing of raised surface perturbations for dispersing electromagnetic radiation.
Figure 5:
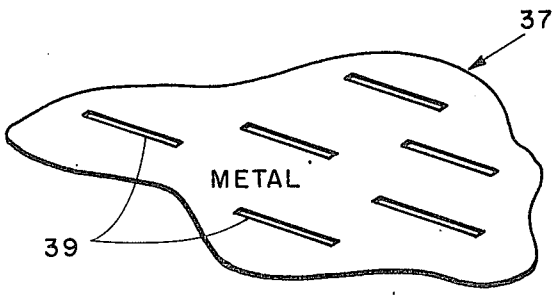
FIG. 5 is a schematic drawing of another form of surface perturbations.
Figure 7:
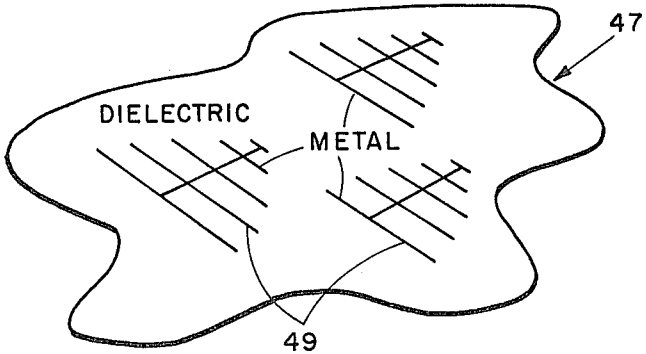
FIG. 7 is a schematic drawing of a form of energy dispersing using metallic grids embedded in a dielectric material.

FIGS. 4–7 illustrate alternate forms of RCS control means which may be desirable in selected applications. In FIG. 4, a metal form 32 preferably cylindrical but optionally conical is constructed having a plurality of holes 34 therein for interrupting a pattern or patterns of reflection. In FIG. 5, a metal form 37 is provided with a plurality of slots 39 for diversive purposes while in FIG. 6 a metal form 42 is provided with a plurality of surface perturbations 44 for effectively defocusing emergent energy. FIG. 7 illustrates a dielectric form 47 which has positioned therein a plurality of metal grids 49 for electrically defocusing reflected energy.

The present invention thus provides a method and means for defocusing electromagnetic energy emerging from an engine cavity so that the emergent energy is diffused and presents a poor radar target. The invention also serves to enhance the so-called high order modes or surface waves within the cavity which, in turn, increases the electrical current density on the cavity walls. The various forms of the invention are compatible with aircraft aero-propulsion performance requirements and, in addition, complement other energy diverting devices thereby providing a greater degree of RCS control or an improved strength, weight or temperature capability. The surface perturbations of the invention which interact with the electromagnetic energy may be varied in size within wide limits in relation to the radar wavelength, and their spacing may be selected to enhance interaction of the electromagnetic energy so as to provide diffuse scattering of energy or accentuation of the surface waves.

The embodiments having openings which promote diffuse scattering are made of metal which can withstand the extreme temperature and pressure of the environment, while the dielectric form of the invention can be deployed on or in a ceramic form which can withstand the environmental conditions. In the preferred embodiment shown in FIG. 3, control means 20 preferably is a metal cylinder slotted as shown and inserted within exhaust nozzle 24 which in this case is conical. The attenuating slots also may be placed in the actual cavity wall or walls. Control means 20 may be supported in the engine cavity by either conductive or non-conductive brackets which selectively space it from the cavity walls. The support for control means 20 also may be either a conductive or non-conductive liner which is attached thereto and to the cavity walls. A reduction of the RCS in this embodiment of up to a factor of 10 db may be achieved for many inlets and nozzle cavities. A significant reduction in the RCS of these critical aircraft components is thus provided.

Obviously many modifications and variations of the invention are possible in the light of the foregoing teachings.

What is claimed is:

1. A device for substantially dispersing the radar wave and other electromagnetic energy entering aircraft engine and other reflective cavities comprising:

an areal arrangement of a plurality of electromagnetic energy attenuating means disposed in each cavity; and metal brackets supporting said attenuating means in said cavity, said attenuating means disposed adjacent to the interior walls and the entrance of said cavity and including a metal cylinder having openings therein configured to selectively dislocate reflective paths of said reflected electromagnetic energy, said attenuating means interacting with the electromagnetic energy to be dispersed so as to cause electromagnetic energy reflected within said cavity to be defocused and scattered over a broad range of angles at the cavity entrance.

2. A device for substantially dispersing the radar wave and other electromagnetic energy entering aircraft engine and other reflective cavities comprising:

an areal arrangement of a plurality of electromagnetic energy attenuating means disposed in each cavity; and non-conductive brackets securing said attenuating means to the walls of said cavity, said attenuating means disposed adjacent to the interior walls and the entrance of said cavity and including a metal cylinder having openings therein configured to selectively dislocate reflective paths of said reflected electromagnetic energy, said attenuating means interacting with the electromagnetic energy to be dispersed so as to cause electromagnetic energy reflected within said cavity to be defocused and scattered over a broad range of angles at the cavity entrance.

3. A device for substantially dispersing the radar wave and other electromagnetic energy entering aircraft engine and other reflective cavities comprising:

an areal arrangement of a plurality of electromagnetic energy attenuating means disposed in each cavity; and means supporting said attenuating means in said cavity, said attenuating means disposed adjacent to the interior walls and the entrance of said cavity and including a metal cylinder having surface perturbations formed to defocus emergent energy, said defocusing causing an increased electrical current density on the cavity walls which can be attenuated in a lossy material associated with said cavity, said attenuating means interacting with the electromagnetic energy to be dispersed so as to cause electromagnetic energy reflected within said cavity to be defocused and scattered over a broad range of angles at the cavity entrance.

4. A device for substantially dispersing the radar wave and other electromagnetic energy entering aircraft engine and other reflective cavities comprising:

an areal arrangement of a plurality of electromagnetic energy attenuating means disposed in each cavity; and means supporting said attenuating means in said cavity, said attenuating means disposed adjacent to the interior walls and the entrance of said cavity and including a cylinder made of dielectric material having metallic means affixed thereto for selectively dislocating reflective paths of said reflected electromagnetic energy, said attenuating means interacting with the electromagnetic energy to be dispersed so as to cause electromagnetic energy reflected within said cavity to be defocused and scattered over a broad range of angles at the cavity entrance.

5. The device as defined in claim 4 wherein said metallic means are metal dipoles.

6. The device as defined in claim 5 wherein said means supporting said cylinder are non-conductive and selectively space said attenuating means from the walls of said cavity.

* * * * *